US009895912B1

(12) United States Patent
Izawa et al.

(10) Patent No.: US 9,895,912 B1
(45) Date of Patent: Feb. 20, 2018

(54) PRINTING METHOD

(71) Applicant: Miyakoshi Printing Machinery Co., Ltd., Narashino-shi, Chiba (JP)

(72) Inventors: Hideo Izawa, Narashino (JP); Osamu Ebuchi, Narashino (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 0 days.

(21) Appl. No.: 15/477,458

(22) Filed: Apr. 3, 2017

(30) Foreign Application Priority Data

Nov. 11, 2016 (JP) ..... 2016-220791

(51) Int. Cl.
*B41J 13/32* (2006.01)
*B41J 13/00* (2006.01)

(52) U.S. Cl.
CPC ..... *B41J 13/32* (2013.01); *B41J 13/0009* (2013.01)

(58) Field of Classification Search
CPC ..... B41J 13/32; B41J 13/0009; A01B 12/006
See application file for complete search history.

(56) References Cited

U.S. PATENT DOCUMENTS 6,249,666 B1 * 6/2001 Newell, Jr. ..... B41J 13/0009 399/391
2014/0140744 A1 * 5/2014 Akai ..... G03G 15/607 399/371
2015/0381851 A1 * 12/2015 Takemura ..... H04N 1/3872 358/1.18

FOREIGN PATENT DOCUMENTS

JP 2006-225128 A 8/2006
JP 2013-022917 A 2/2013

* cited by examiner

*Primary Examiner* — Lamson Nguyen
(74) *Attorney, Agent, or Firm* — Flynn, Thiel, Boutell & Tanis, P.C.

(57) ABSTRACT

To provide a printing method capable of inhibiting a paper sheet from being damaged at the time of conveyance and efficiently starting reprinting with high positional accuracy after printing is once stopped.
The present invention is directed to a printing method of printing a unit image G by a printing part 2 based on detection of a reference punched hole 41 of a hole detection sensor 4 to form a print portion P1, then stopping printing to form a non-print portion P0, then by a mark detection sensor 3 detecting a register mark G2, recognizing a boundary between the print portion P1 and the non-print portion P0, and reprinting the unit image G from the non-print portion P0 based on detection of the reference punched hole 41 by the hole detection sensor 4.

7 Claims, 4 Drawing Sheets

PRINTING METHOD

TECHNICAL FIELD

The present invention relates to printing methods and, in more detail, a printing method capable of inhibiting a paper sheet from being damaged at the time of conveyance and efficiently starting reprinting with high positional accuracy after printing is once stopped.

BACKGROUND ART

In a printing apparatus which prints at a printing part while conveying a long paper sheet at high speed, rapidly stopping the paper sheet being conveyed at high speed puts a large mechanical load, and causes a malfunction of the apparatus itself.

Thus, in the printing apparatus, when printing is once stopped, instead of rapidly stopping the paper sheet being conveyed at high speed, measures of decelerating the running speed of the paper sheet and then stopping have been taken.

Therefore, when printing is once stopped, a situation occurs in which a non-printed portion passes through a printing part by the time when the paper sheet completely stops.

From this, in the above-described printing apparatus, when printing is started again after printing is once stopped, in order to prevent the non-printed portion passing through the printing part from being wasted, a method is taken in which the paper sheet is conveyed in a reverse direction so that a last-printed portion passes through the printing part and then reprinting by the printing part is started from the next portion of the last-printed portion.

And, methods of efficiently performing this series of processes have been studied.

For example, an image forming apparatus has been known in which a mark is formed at a position corresponding to a last-formed image on a long paper sheet and, when image formation ends, the long paper sheet is moved in a reverse direction and the mark is detected by detecting means, thereby performing control so as to stop movement of the long paper sheet in the reverse direction (for example, refer to PTL 1).

Also, a recording apparatus has been known, including a deceleration-occasion movement amount detecting part which detects, by a rotary encoder, a movement amount of a recording medium in a deceleration period from the start of a stop of conveyance of a recording medium with completion of recording of an image as to one job until the conveyance stop is completed and a start-locating process performing part which performs a start-locating process for starting recording of an image as to the next job of the one job (for example, refer to PTL 2).

CITATION LIST

Patent Literature

PTL 1: Japanese Patent Application Laid-Open No. 2006-225128

PTL 2: Japanese Patent Application Laid-Open No. 2013-22917

SUMMARY OF INVENTION

Technical Problem

However, in the image forming apparatus described in PTL 1, since movement of the long paper sheet is stopped with reference to the formed mark, when image formation is newly performed next, there is a possibility that printing at a correct position on the long paper sheet cannot be made. That is, while an image is newly formable at a position corresponding to the formed mark, it does not necessarily mean that an image can be newly formed at a correct position on the long paper sheet.

On the other hand, in the recording apparatus described in PTL 2, it is assumed that the movement amount of the recording medium and the rotation amount of a conveyance roller are equal to each other. However, since sliding occurs between the conveyance roller and the recording medium, performing a start-locating process for starting image recording based on the detection result of the deceleration-occasion movement amount detecting part is definitely far from having excellent positional accuracy.

Note that when a paper sheet provided with marginal punched holes is used, it is possible to hook projections on a tractor field into the marginal punched holes for conveyance, and therefore a start can be located for recording an image with high accuracy by calculating a paper-sheet conveyance distance from the angle of rotation of a drive shaft of the tractor field.

In this case, however, it is required to hook the projections into the marginal punched holes and pull the paper sheet. Therefore, there is a drawback that the paper sheet may be damaged. Moreover, the projections may be disengaged from the marginal punched holes, and a conveyance-disabled situation may occur.

The present invention was made in view of the above-described circumstances, and has an object of providing a printing method capable of inhibiting a paper sheet from being damaged at the time of conveyance and efficiently starting reprinting with high positional accuracy after printing is once stopped.

Solution to Problems

With diligent studies to solve the above-described problems, the inventors have found that the above-described problems can be solved by conveying a paper sheet by using a press roller and a drive roller, allowing a boundary between a print portion and a non-print portion to be recognized based on detection of a printed register mark by a mark detection sensor and, by a hole detection sensor detecting a reference punched hole from the boundary, printing a unit image by a printing part, leading to completion of the present invention.

The present invention resides in (1) a printing method using a printing apparatus having a paper-feeding part which supplies a long paper sheet with a plurality of punched holes provided on both sides along a longitudinal direction, a printing part which prints a unit image formed of an image and a register mark on the paper sheet, a mark detection sensor for detecting the register mark, a hole detection sensor for detecting a reference punched hole set from among the plurality of punched holes, a press roller and a drive roller for nipping the paper sheet for conveyance, and a collecting part which collects the printed paper sheet, the mark detection sensor and the hole detection sensor disposed between the paper-feeding part and the printing part in a conveyance route of the paper sheet, the method including a first conveying step of conveying the paper sheet in a forward direction from the paper-feeding part to the collecting part by forwardly rotating the drive roller, a printing step of detecting, by the hole detection sensor, the reference punched hole during the first conveying step and, based on the detection, printing, by the printing part, the unit image to form a print portion, a second conveying step of stopping the printing to form a non-print portion and simultaneously applying a brake to the drive roller to gradually decelerate and then stop the conveyance of the paper sheet in the forward direction, a third conveying step of conveying the paper sheet in a reverse direction from the collecting part to the paper-feeding part by reversely rotating the drive roller, a fourth conveying step of applying a brake to the drive roller to gradually decelerate and then stop the conveyance of the paper sheet in the reverse direction, a count step of detecting, by the mark detection sensor, the passing register mark during the third conveying step and the fourth conveying step and taking a count of the detection, a fifth conveying step of conveying the paper sheet in the forward direction from the paper-feeding part to the collecting part by forwardly rotating the drive roller, a recognizing step of detecting, by the mark detection sensor, the passing register mark during the fifth conveying step and recognizing a rear end of the unit image having the register mark printed thereon when the count of the detection matches a count number taken at the count step as a boundary between the print portion and the non-print portion, and a reprinting step of detecting, by the hole detection sensor, the reference punched hole of the non-print portion during the fifth conveying step and, based on the detection, reprinting, by the printing part, the unit image on the paper sheet, wherein a pitch between the reference punched holes matches a length of the unit image in a paper-sheet conveying direction.

The present invention resides in the printing method described in the above-described (1) in which, (2) at a position opposing the hole detection sensor, a guide roll for guiding the paper sheet is disposed via the paper sheet, and a color of the guide roll is different from a color of a circumferential edge of the punched holes of the paper sheet.

The present invention resides in the printing method described in the above-described (1) in which, (3) at the fourth conveying step, based on detection of the register mark by the mark detection sensor, a brake is applied to the drive roller.

The present invention resides in the printing method described in the above-described (1) in which, (4) the press roller is attachable to and detachable from the drive roller, and the method further includes a first tension adjusting step of once detaching the press roller from the drive roller before the third conveying step and then causing the press roller to abut on the drive roller during the third conveying step, and a second tension adjusting step of once detaching the press roller from the drive roller before the fifth conveying step and then causing the press roller to abut on the drive roller during the fifth conveying step.

The present invention resides in the printing method described in the above-described (4) in which, (5) a plurality of said press rollers and said drive rollers are provided, at the first tension adjusting step, the press rollers are sequentially caused to abut on the drive rollers from an upstream side with respect to a conveying direction of the paper sheet at the third conveying step, and at the second tension adjusting step, the press rollers are sequentially caused to abut on the drive rollers from an upstream side with respect to a conveying direction of the paper sheet at the fifth conveying step.

The present invention resides in the printing method described in the above-described (1) in which, (6) a meander preventing apparatus is provided on a paper-feeding part side rather than the printing part, the mark detection sensor, and the hole detection sensor in the conveyance route of the paper sheet.

The present invention resides in the printing method described in the above-described (1) in which, (7) the plurality of punched holes provided on both sides of the paper sheet along the longitudinal direction are marginal punched holes, and a space between the unit images is sectioned by perforations.

Advantageous Effects of Invention

In the printing method of the present invention, in a state in which a long paper sheet with a plurality of punched holes provided on both sides along a longitudinal direction is nipped by the press roller and the drive roller, the drive roller is forwardly rotated or reversely rotated, thereby causing the paper sheet to be conveyed in a direction corresponding to the rotating direction of the drive roller. In this manner, in the above-described printing method, the paper sheet is not conveyed by using punched holes. Therefore, it is possible to inhibit the paper sheet from being damaged as much as possible at the time of conveyance.

In the printing method of the present invention, when the paper sheet is conveyed in a reverse direction and is then conveyed in a forward direction, the mark detection sensor detects a passing register mark during that time for counting, thereby allowing a boundary between the print portion and the non-print portion to be recognized. With this, it is possible to reprint from an initial position of the non-print portion continued to the print portion.

Also, reprinting is performed with reference to not the register mark included in the unit image but the reference punched hole formed in the paper sheet itself. Therefore, reprinting with high accuracy can be made.

From these, in the printing method of the present invention, by including the first conveying step, the printing step, the second conveying step, the third conveying step, the fourth conveying step, the count step, the fifth conveying step, the recognizing step, and the reprinting step, the paper sheet can be inhibited from being damaged at the time of conveyance, and reprinting can be efficiently started with high positional accuracy after printing is once stopped.

In the printing method of the present invention, the guide roll is disposed at the position opposing the hole detection sensor, and the color of the guide roll is different from the color of the circumferential edge of the punched holes of the paper sheet. Therefore, the hole detection sensor can easily recognize the reference punched hole.

With this, an erroneous detection by the hole detection sensor can be prevented.

In the printing method of the present invention, at the fourth conveying step, based on detection of the register mark by the mark detection sensor, a brake is applied to the drive roller. Therefore, a sufficient amount of the print portion can be conveyed to the printing part on a paper-sheet feeding side.

With this, at the reprinting step, by accelerating the speed of conveying the paper sheet in the forward direction until the non-print portion reaches the printing part, the conveying speed of the paper sheet can be made constant at the time of reprinting.

In the printing method of the present invention, by further including the first tension adjusting step or the second tension adjusting step, a change in tension provided to the paper sheet due to a change in the direction in which the paper sheet is conveyed can be eliminated. As a result, it is possible to prevent the paper sheet from being expanded due to excessive pulling and prevent the paper sheet from being wrinkled.

Note that at the first tension adjusting step and the second tension adjusting step, the press rollers are preferably sequentially caused to abut on the drive rollers from an upstream side in the paper-sheet conveying direction.

In the printing method of the present invention, by providing a meander preventing apparatus, it is possible to inhibit the paper sheet being conveyed from being shifted in the width direction.

In addition, by providing the meander preventing apparatus on a paper-feeding part side rather than the printing part, the mark detection sensor, and the hole detection sensor in the conveyance route of the paper sheet, a print shift by the printing part, a register-mark detection error by the mark detection sensor, and a reference-punched-hole detection error by the hole detection sensor can be prevented. That is, at the printing step, the count step, the recognizing step, and the reprinting step, an error occurring due to a shift of the paper sheet in the width direction can be prevented.

In the printing method of the present invention, even if the plurality of punched holes provided on both sides of the paper sheet along the longitudinal direction are so-called marginal punched holes, the paper sheet can be inhibited from being damaged at the time of conveyance.

Also, even if a space between the unit images is sectioned by perforations, reprinting can be efficiently started with high positional accuracy after printing is once stopped.

(a) to (f) of FIG. 3 are schematic upper surface views for describing each step in the printing method according to the present embodiment.

Figure 4:
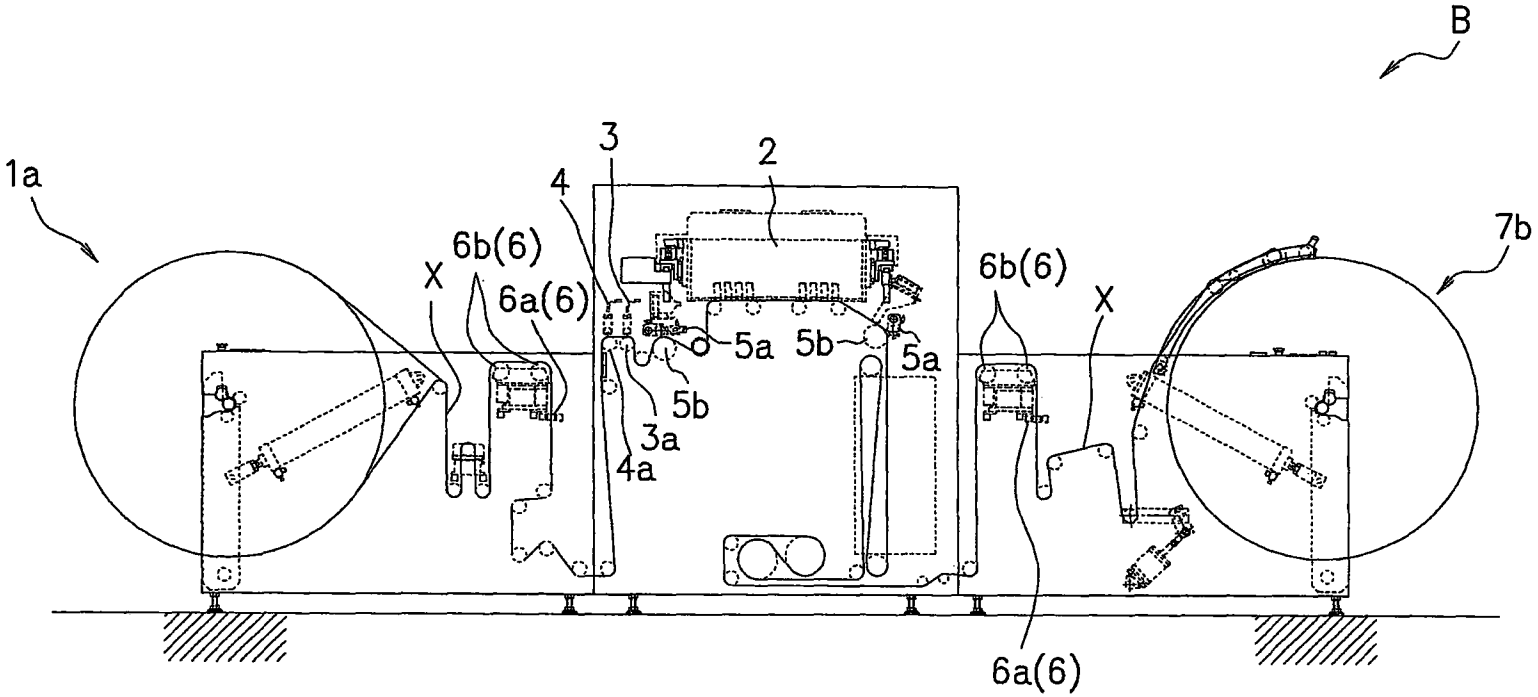

FIG. 4 is a schematic side view schematically depicting another printing apparatus where the printing method according to the present embodiment is used.

DESCRIPTION OF EMBODIMENTS

In the following, with reference to the drawings as necessary, suitable embodiments of the present invention are described in detail. Note in the drawings that the same elements are provided with the same reference numeral and redundant description is omitted. Also, it is assumed that a positional relation such as above, below, left, or right is based on the positional relation depicted in the drawings, unless otherwise particularly specified. Furthermore, the dimensional ratio in the drawings is not restricted to the ratio depicted in the drawings.

First, a printing apparatus where the printing method according to the present embodiment is used is described.

The printing apparatus where the printing method according to the present invention is used is an apparatus for forming an image such as a pattern and/or character on a paper sheet.

Specifically, as this printing apparatus, a digital printing apparatus is suitably used, such as an inkjet printing apparatus, an electrophotography printing apparatus, or a laser printing apparatus. Among these, an inkjet printing apparatus of a line-head type is preferably used.

Figure 1:
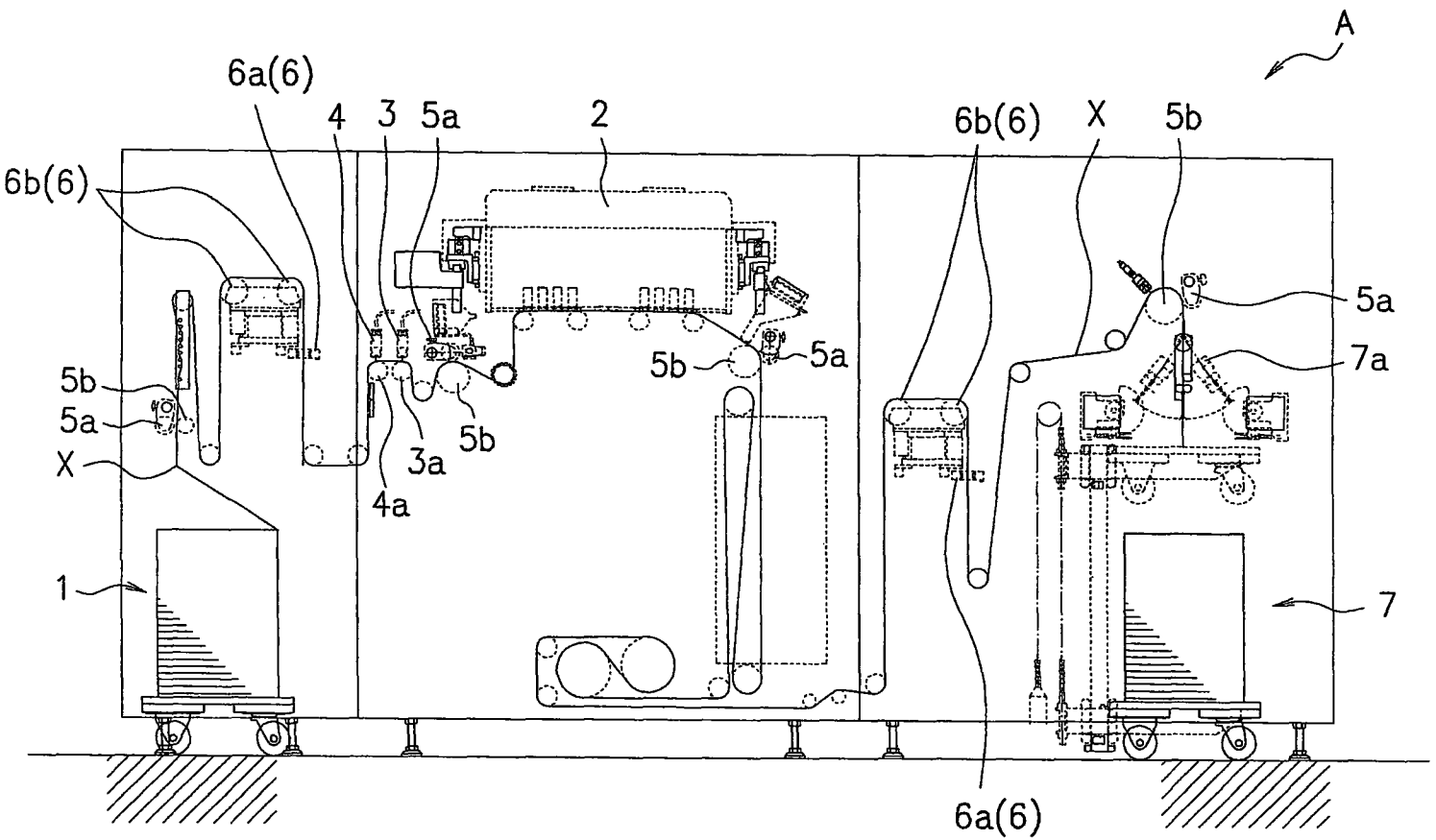
FIG. 1 is a schematic side view schematically depicting a printing apparatus where the printing method according to the present embodiment is used.

FIG. 1 is a schematic side view schematically depicting the printing apparatus where the printing method according to the present embodiment is used.

As depicted in FIG. 1, a printing apparatus A where the printing method according to the present embodiment is used has a paper-feeding part 1 which supplies a long paper sheet X with a plurality of punched holes provided on both sides along a longitudinal direction, a printing part 2 which repeatedly prints a unit image formed of an image and a register mark on the paper sheet X, a mark detection sensor 3 for detecting the register mark, a hole detection sensor 4 for detecting a reference punched hole set from among the plurality of punched holes, press rollers 5*a* and drive rollers 5*b* for nipping the paper sheet X for conveyance, a collecting part 7 which collects the printed paper sheet X, and meander preventing apparatuses 6 for preventing a meander of the paper sheet X.

In the printing apparatus A, the paper sheet X is supplied from the paper-feeding part 1, printing is performed at the printing part 2 on the paper sheet X, and the printed paper sheet X is collected at the collecting part 7.

In the printing apparatus A, the paper sheet X for use is long, and has a shape in which perforations are provided with predetermined pitches in a direction (width direction) perpendicular to the longitudinal direction.

Also, the paper sheet X is provided with the plurality of punched holes on both sides along the longitudinal direction.

Here, in the paper sheet X, these punched holes may be so-called marginal punched holes. Note that in the case of marginal punched holes, the respective punched holes are aligned on both left and right ends continuously with ½-inch pitches, and has a perfect-circle shape with a diameter of ⅙ inches or an oval shape obtained by slightly spreading the perfect circle laterally.

Therefore, as a specific example of the paper sheet X, so-called fanfold paper provided with perforations and marginal punched holes can be cited.

In the printing apparatus A, the paper-feeding part 1 sequentially feeds the paper sheet X. That is, in the printing apparatus A, the paper-feeding part 1 sequentially feeds the paper sheet X placed as being alternately folded along perforations.

Note that since a method of feeding the paper sheet X is a known method in the paper-feeding part 1, detailed description thereof is omitted.

In the printing apparatus A, the printing part 2 repeatedly prints a unit image formed of an image and a register mark on the paper sheet X.

Here, the unit image is formed of an image for one page (also including margins if present before and after the image) and a rectangular register mark provided outside the image. Note that when the unit image is repeatedly printed, the register mark is printed always at the same position in each image.

In the unit image, the length of the image for one page in a paper-sheet conveying direction can be set as appropriated.

Incidentally, in the above-described paper-sheet X, as described above, perforations are provided with predetermined pitches, and therefore a space between perforations is set as one page.

In the printing apparatus A, the mark detection sensor 3 is a sensor which detects a register mark in the unit image printed by the printing part 2. Note that, as the mark detection sensor 3, an optical sensor such as a color sensor is suitably used.

As will be described further below, in the printing method according to the present embodiment, after the mark detection sensor 3 detects a register mark, the hole detection sensor detects a reference punched hole, and printing is performed thereby. Thus, the mark detection sensor 3 is disposed in a conveyance route of the paper sheet X on a paper-feeding part 1 side rather than the printing part 2, that is, between the paper-feeding part 1 and the printing part 2.

Note that the mark detection sensor 3 is preferably disposed at a substantially same position as that of the hole detection sensor.

In the printing apparatus A, at a position opposing the mark detection sensor 3, a guide roll 3*a* for guiding the paper sheet X is disposed via the paper sheet X.

With this, it is possible to inhibit a register-mark detection error from occurring due to flutter or the like of the paper sheet X during conveyance.

In the printing apparatus A, the reference punched hole is set from among the plurality of punched holes provided in the paper sheet X.

Specifically, first, a portion as a tip (perforations) of the unit image to be printed on the paper sheet X is attached to an initial paper-sheet set position provided in the paper-sheet conveyance route of the printing apparatus A.

Here, a distance between the initial paper-sheet set position and the hole detection sensor is measured in advance.

And, from that state, when the paper sheet X is started to be conveyed, a punched hole first detected by the hole detection sensor is taken as a reference punched hole.

Note that since the position of the reference punched hole and the position of the tip (perforations) of one page of the unit image are defined, a distance from the tip (perforations) of one page of the unit image to the reference punched hole can also be found.

Also, the pitch between reference punched holes matches the length of the unit image in the paper-sheet conveying direction. That is, as described above, since the unit image has an image for one page (also including margins if present before and after the image), the pitch between reference punched holes corresponds to the length of the image for one page in the conveying direction of the paper sheet X.

Therefore, to the unit image, one reference punched hole is set.

In the printing apparatus A, the hole detection sensor 4 is, as described above, a sensor for detecting a reference punched hole. Note that as the hole detection sensor 4, an optical sensor such as a color sensor is suitably used.

The hole detection sensor 4 detects a reference punched hole, and does not detect a punched hole other than a reference punched hole. That is, after detecting an initial reference punched hole, the hole detection sensor 4 detects a reference punched hole at a position of the paper sheet X conveyed for one unit image, and is set so as not to detect a punched hole between reference punched holes.

Note that since a distance from the hole detection sensor 4 to the tip of a print head nozzle of the printing part 2 is also measured in advance in actual printing, from this and the length of the unit image in the paper-sheet conveying direction, print start timing after detection of a reference punched hole is automatically set.

Here, each reference punched hole to be detected by the hole detection sensor 4 is selected based on a theoretical amount of conveyance of the paper sheet X for a unit image calculated based on a pulse signal from a control part, which will be described further below.

Incidentally, for a reason such that sliding occurs between the paper sheet X and the drive rollers 5*b*, the theoretical amount of conveyance of the paper sheet X and the actual amount of conveyance of the paper sheet X may not match each other and, as a result, the theoretical position of the reference punched hole and the actual position of the reference punched hole may not match each other. Thus, the hole detection sensor 4 can detect a reference punched hole in a range of error of ±5 mm.

Based on the detection signal of the hole detection sensor 4, the position of the paper sheet X on which the printing part 2 starts printing can be found from the distance from the hole detection sensor 4 to the position where the printing part 2 starts printing (position of the tip of the print head nozzle) because of being defined as described above, the distance for the unit image, and the distance from the tip (perforations) of the unit image to the reference punched hole.

As will be described further below, in the printing method according to the present embodiment, printing is performed after the hole detection sensor 4 detects a reference punched hole. Thus, the hole detection sensor 4 is disposed on the paper-feeding part 1 side rather than the printing part 2, that is, between the paper-feeding part 1 and the printing part 2.

Also, in consideration of control from a time when the hole detection sensor 4 detects a reference punched hole to a time when the printing part 2 actually prints and a time required for a response, the hole detection sensor 4 is preferably set at a position away from the printing part 2 by 100 mm or longer on an upstream side.

In the printing apparatus A, at the position opposing the hole detection sensor 4, a guide roll 4*a* for guiding the paper sheet X is disposed via the paper sheet X.

With this, it is possible to inhibit a reference-punched-hole detection error from occurring due to flutter or the like of the paper sheet X during conveyance.

Also, the color of the guide roll 4*a* is preferably different from the color of a circumferential edge of the punched holes of the paper sheet X. For example, when the paper sheet X is white, the guide roll 4*a* may be black or others. In this case, the hole detection sensor 4 can easily recognize a reference punched hole, and an erroneous detection by the hole detection sensor 4 can be more prevented.

In the printing apparatus A, the press rollers 5*a* and the drive rollers 5*b* are to nip the paper sheet X for conveyance.

In the printing apparatus A, since the press rollers 5*a* and the drive rollers 5*b* are used for conveyance of the paper sheet X, the projections on the tractor field are not hooked into the marginal punched holes. Thus, it is possible to prevent the paper sheet X from being damaged as much as possible and is also prevent an occurrence of a situation in which the projections on the tractor field are disengaged from the marginal punched holes to disable conveyance.

The drive roller 5*b* is rotated by a motor (not depicted) as a drive source in a forward direction or a reverse direction opposite thereto. And, based on the rotation of the drive roller 5*b*, the paper sheet X is conveyed in the forward direction or the reverse direction.

Note in the specification that the "forward direction" means a direction in which the paper sheet X is conveyed from the paper-feeding part 1 to the collecting part 7 in the conveyance route of the paper sheet X and the "reverse direction" means a direction in which the paper sheet X is conveyed from the collecting part 7 to the paper-feeding part 1 in the conveyance route of the paper sheet X.

Here, the control part (not depicted) controls the rotation of the motor. That is, based on a pulse signal from the control part, the motor rotates the drive roller 5*b*, thereby causing the paper sheet X to be conveyed.

Therefore, based on a pulse signal sent out by the control part, the paper sheet X is conveyed by a predetermined distance.

Note that the control part is formed of a general-purpose computer having a central processing unit (CPU), an input/output interface, a RAM and a ROM as recording media, communicating means with respect to an external computer or the like, an internal storage part such as a hard disk, and a driver for using a predetermined external recording medium.

The press roller 5*a* is attachable to and detachable from the drive roller 5*b*. Thus, by pressing the paper sheet X from above to the drive roller 5*b*, the press roller 5*a* prevents the paper sheet X from slipping between the press roller 5*a* and the drive roller 5*b*.

Also, because of being able to freely rotate, the press roller 5*a* rotates correspondingly to the rotation of the drive roller 5*b*.

In the printing apparatus A, the press roller 5*a* and the drive roller 5*b* are provided between the paper-feeding part 1 and a forward meander preventing apparatus 6, which will be described further below, between the mark detection sensor 3 and the printing part 2, between the printing part 2 and a backward meander preventing apparatus 6, which will be described further below, and between the backward meander preventing apparatus 6 and the collecting part 7.

In this manner, by providing the plurality of press rollers 5*a* and drive rollers 5*b*, the paper sheet X can be reliably conveyed without warpage of the paper sheet X, with a certain tension kept.

In the printing apparatus A, the collecting part 7 collects the paper sheet X printed by the printing part 2. That is, in the printing apparatus A, since the paper sheet X is provided with perforations, a pendulum part 7*a* of the collecting part 7 swings the paper sheet X forwardly and backwardly, thereby causing the paper sheet X to be alternately folded along the perforations and be collected.

Note in the collecting part 7 that a method of collecting the paper sheet X is a known method and therefore detailed description is omitted.

In the printing apparatus A, to prevent a meander of the paper sheet X, the meander preventing apparatus (for convenience, hereinafter also referred to as "forward meander preventing apparatus) 6 is provided on a paper-feeding part 1 side rather than the printing part 2, the mark detection sensor 3, and the hole detection sensor 4 in the conveyance route of the paper sheet X, and the meander preventing apparatus (for convenience, hereinafter also referred to as "backward meander preventing apparatus) 6 is provided between the printing part 2 and the collecting part 7 in the conveyance route of the paper sheet X. Note that as a specific example of this meander preventing apparatus 6, an edge guide controller can be cited.

The forward meander preventing apparatus 6 and the backward meander preventing apparatus 6 both include a detecting part 6*a* and a twist-purpose roller 6*b*, the detecting part 6*a* detecting a passage position of an edge portion of the paper sheet X and, when that passage position has an anomaly, the twist-purpose roller 6*b* is tilted to correct the passage position of the paper sheet X so that the passage position is appropriate.

Note that since the meander preventing apparatus 6 is a known apparatus, detailed description is omitted.

In the printing apparatus A, since the forward meander preventing apparatus 6 is included, a print shift by the printing part 2, a register-mark detection error by the mark detection sensor 3, and a reference-punched-hole detection error by the hole detection sensor 4 can be prevented.

Also, since the backward meander preventing apparatus 6 is included, when the collecting part 7 collects the paper sheet X, the conveyed paper sheet X can be prevented from being shifted in the width direction.

Note that when the paper sheet X is conveyed in a reverse direction, the correcting direction is switched to a reverse direction.

Next, the printing method according to the present embodiment is described.

The printing method according to the present embodiment is performed by using the above-described printing apparatus A.

Figure 2:
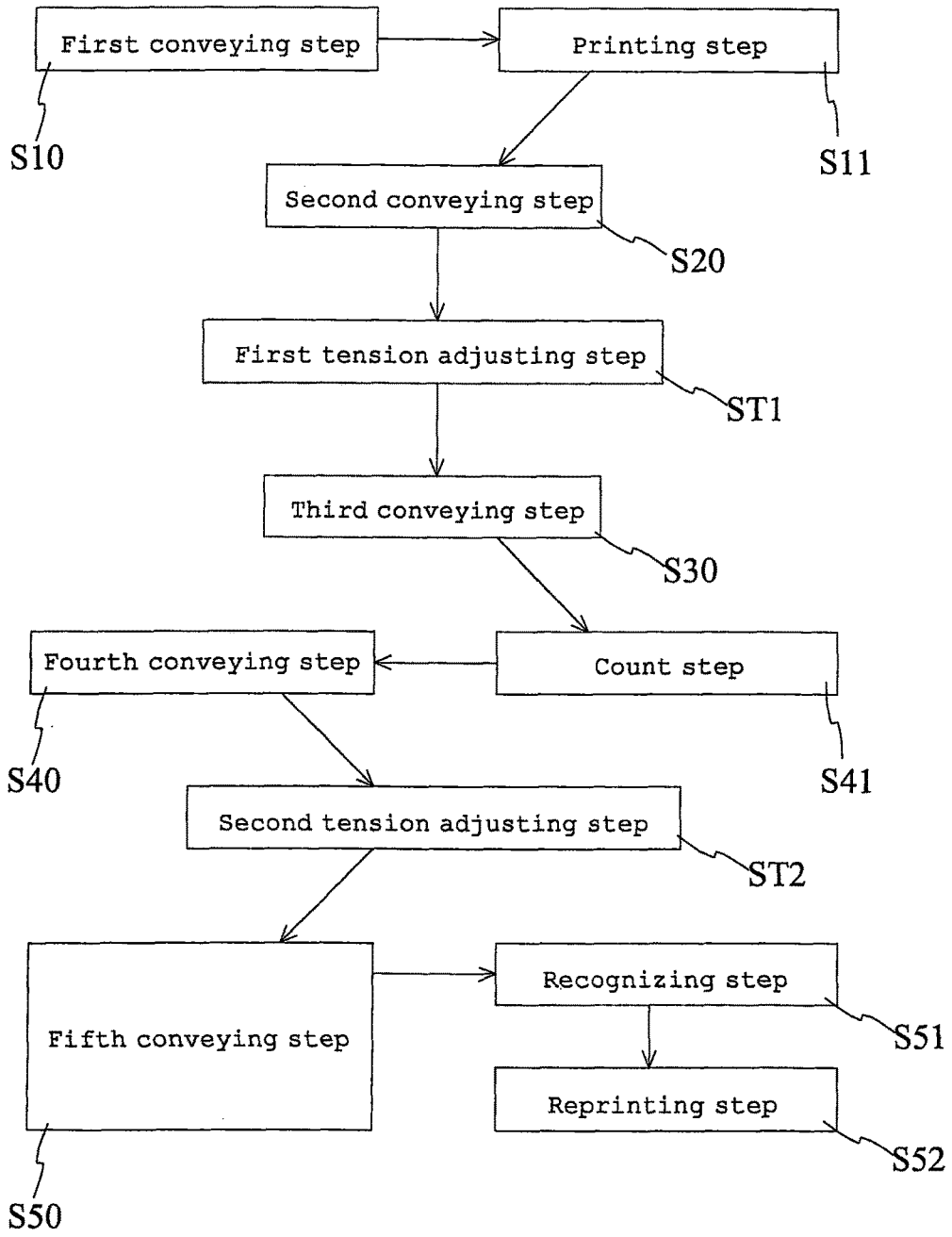
FIG. 2 is a flowchart depicting the printing method according to the present embodiment.
Figure 3A:
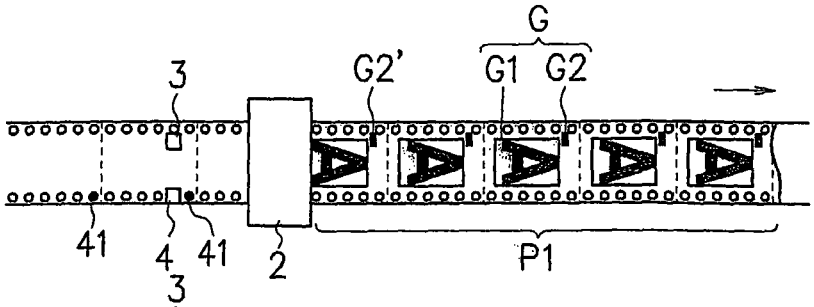
Figure 3B:
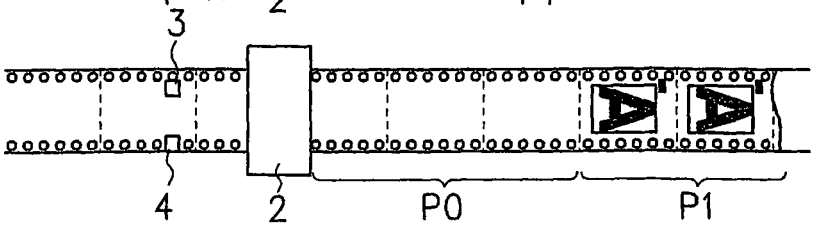
Figure 3C:
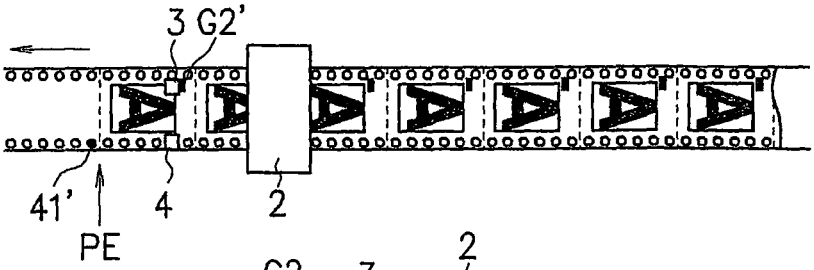
Figure 3D:
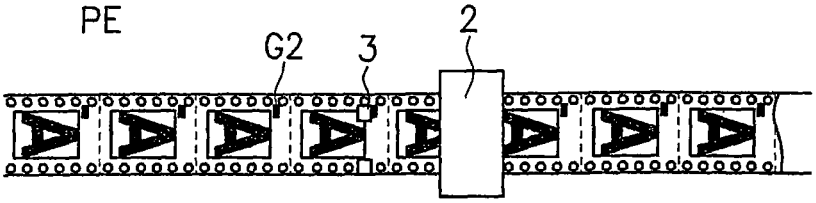
Figure 3E:
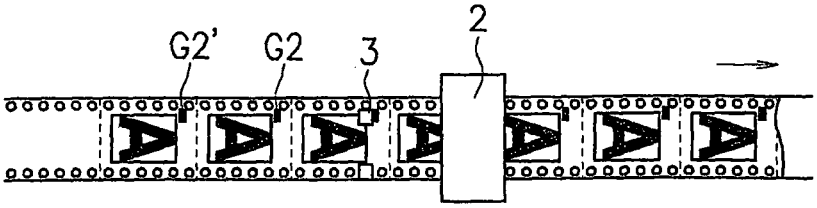
Figure 3F:
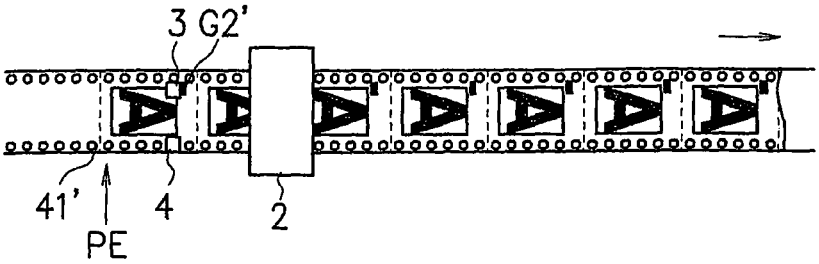

FIG. 2 is a flowchart depicting the printing method according to the present embodiment.

As depicted in FIG. 2, the printing method according to the present embodiment includes a first conveying step S10 of conveying the paper sheet X in a forward direction from the paper-feeding part 1 to the collecting part 7 by forwardly rotating the drive rollers 5*b*; a printing step S11 of detecting, by the hole detection sensor 4, the reference punched hole during the first conveying step S10 and, based on the detection, printing, by the printing part 2, the unit image to form a print portion; a second conveying step S20 of stopping the printing to form a non-print portion and simultaneously applying brakes to the drive rollers 5*b* to gradually decelerate and then stop the conveyance of the paper sheet X in the forward direction; a first tension adjusting step ST1 of once detaching the press rollers 5*a* from the drive rollers 5*b* and then causing the press rollers 5*a* to abut on the drive rollers 5*b*; a third conveying step S30 of conveying the paper sheet X in a reverse direction from the collecting part 7 to the paper-feeding part 1 by reversely rotating the drive rollers 5*b*; a fourth conveying step S40 of applying brakes to the drive rollers 5*b* to gradually decelerate and then stop the conveyance of the paper sheet X in the reverse direction; a count step S41 of detecting, by the mark detection sensor 3, the passing register mark during the third conveying step S30 and the fourth conveying step S40 and taking a count of the detection; a second tension adjusting step ST2 of once detaching the press rollers 5*a* from the drive rollers 5*b* and then causing the press rollers 5*a* to abut on the drive rollers 5*b*; a fifth conveying step S50 of conveying the paper sheet X in the forward direction from the paper-feeding part 1 to the collecting part 7 by forwardly rotating the drive rollers 5*b*; a recognizing step S51 of detecting, by the mark detection sensor 3, the passing register mark during the fifth conveying step S50 and recognizing a rear end of the unit image having the register mark printed thereon when the count of the detection matches a count number taken at the count step S41 as a boundary between the print portion and the non-print portion; and a reprinting step S52 of detecting, by the hole detection sensor 4, the reference punched hole of the non-print portion during the fifth conveying step S50 and, based on the detection, reprinting, by the printing part 2, the unit image on the paper sheet X.

That is, in the printing method according to the present embodiment, conveyance of the paper sheet X is performed in the order of the first conveying step S10, the second conveying step S20, the third conveying step S30, the fourth conveying step S40, and the fifth conveying step S50.

Also, the printing step S11 is started during the first conveying step S10, and ends with the first conveying step S10.

Also, the first tension adjusting step ST1 is started between the second conveying step S20 and the third conveying step S30, and ends during the third conveying step S30.

Also, the count step S41 is started during the third conveying step S30, and ends with the fourth conveying step S40.

Also, the second tension adjusting step ST2 is started between the fourth conveying step S40 and the fifth conveying step S50, and ends during the fifth conveying step S50.

Also, the recognizing step S51 is performed during the fifth conveying step S50, and then the reprinting step S52 is performed.

At the first conveying step S10, by forwardly rotating the plurality of drive rollers 5*b* together, the paper sheet X is conveyed in the forward direction from the paper-feeding part 1 to the collecting part 7.

Note in the specification that "forward rotation" means a rotating direction of the drive roller 5*b* when the paper sheet X is conveyed in the forward direction and "reverse rotation" means a rotating direction of the drive rollers 5*b* when the paper sheet X is conveyed in the reverse direction.

At the first conveying step S10, firstly, from a state in which the paper sheet X has passed from the paper-feeding part 1 to the collecting part 7, the paper sheet X is accelerated, and is then conveyed at a predetermined speed.

Then, at the first conveying step S10, the printing step S11 is performed. Note that the printing step S11 may be started in a state in which the conveyance of the paper sheet X is accelerated or may be started in a state of being at the predetermined speed.

(a) to (f) of FIG. 3 are schematic upper surface views for describing each step in the printing method according to the present embodiment.

At the printing step S11, as depicted in (a) of FIG. 3, the hole detection sensor 4 detects a reference punched hole 41 and, based on the detection, the printing part 2 prints a unit image G formed of an image G1 and a register mark G2.

Here, the position where the printing part 2 actually starts printing based on a detection signal indicating detection of the reference punched hole 41 by the hole detection sensor 4 is set in advance.

That is, upon receiving a detection signal indicating detection of a reference punched hole, the control part sends out a pulse signal corresponding to a distance from the position of the reference punched hole 41 set in advance to a position where printing is started. Based on this, each motor rotates the drive roller 5*b*. After the paper sheet X is conveyed by the above-described distance, the printing part 2 performs printing.

In this manner, with repetition of detection of the reference punched hole 41 and printing based thereon, a print portion P1 is formed where the unit images G are continuously printed on the paper sheet X.

Note that at the first conveying step S10, the rotation speed of the drive roller 5*b* based on the above-described pulse signal from the control part is taken as a base and correction is respectively made so that the rotation speed of the drive roller 5*b* on an upstream side is slightly slower than the rotation speed of the drive roller 5*b* on a downstream side. With this, more appropriate tension is provided to the paper sheet X.

As a result, it is possible to prevent the paper sheet X from being expanded due to excessive pulling and prevent the paper sheet from being wrinkled.

Next, at the second conveying step S20, printing is stopped. Then, the printing part 2 is retracted from the paper sheet X and, simultaneously, brakes are applied to the drive rollers 5*b*.

With this, the conveyance of the paper sheet X in the forward direction is gradually decelerated and then stopped.

Here, the paper sheet X is conveyed by a predetermined amount in the forward direction even after printing is stopped. Thus, as depicted in (b) of FIG. 3, in the paper sheet X passing through the printing part 2, a non-print portion P0 not printed by the printing part 2 is formed.

After the conveyance of the paper sheet X is stopped at the second conveying step S20, the first tension adjusting step ST1 is performed.

At the first tension adjusting step ST1, the press rollers 5*a* are once detached from the drive rollers 5*b* (refer to FIG. 1).

At the second conveying step S20 and the third conveying step S30, the directions in which the paper sheet X is conveyed are opposite, and therefore the tension provided to the paper sheet X is changed. However, by performing the first tension adjusting step ST1, the tension provided to the paper sheet X at the second conveying step S20 can be once eliminated.

Also, at the first tension adjusting step ST1, during acceleration of the paper sheet at the third conveying step S30, which will be described further below, the press rollers 5*a* are sequentially caused to abut on the drive rollers 5*b* from the upstream side with respect to the paper-sheet conveying direction.

With this, from the upstream side in the conveying direction, tension of the paper sheet X can be sequentially stabilized with a short span, and therefore the behavior of the paper sheet can be stabilized in a short time.

Next, at the third conveying step S30, by reversely rotating the plurality of drive rollers 5*b* together, the paper sheet X is conveyed in the reverse direction from the collecting part 7 to the paper-feeding part 1.

Note that at the third conveying step S30, the rotation speed of the drive roller 5*b* based on the above-described pulse signal from the control part is taken as a base and correction is respectively made so that the rotation speed of the drive roller 5*b* on the upstream side is slightly slower than the rotation speed of the drive roller 5*b* on the downstream side. With this, more appropriate tension is provided to the paper sheet X.

Incidentally, at the first conveying step S10, the drive roller 5*b* on the paper-feeding part 1 side is rotated at a speed slower than that of the drive roller 5*b* on a collecting part 7 side. However, at the third conveying step S30, since the conveying direction is opposite to that of the first conveying step S10, the drive roller 5*b* on the collecting part 7 side is rotated at a speed slower than that of the drive roller 5*b* on the paper-feeding part 1 side.

Then, at the fourth conveying step S40, as depicted in (c) of FIG. 3, based on detection of a register mark G2' at a rear end by the mark detection sensor 3, brakes are applied to the drive rollers 5*b*.

With this, the conveyance of the paper sheet X in the reverse direction is gradually decelerated and then stopped.

Here, as depicted (d) of FIG. 3, a sufficient amount of the print portion P1 is conveyed to the printing part 2 on a paper-feeding part 1 side. Thus, at the reprinting step S52, until the non-print portion P0 reaches the printing part 2, the speed of conveying the paper sheet X in the forward direction can be sufficiently accelerated.

Note that the position where the paper sheet X starts decelerating and the position where the paper sheet X stops may be positions based on the above-described pulse signal of the control part. That is, by stopping each motor based on a pulse signal sent out by the control part, the paper sheet X can be stopped also at an intentional position.

Also, at the third conveying step S30 and the fourth conveying step S40, the count step S41 is performed. The count step S41 may be performed from the start of the third conveying step S30 or in the course thereof.

At the count step S41, the mark detection sensor 3 detects the passing register mark G2, and takes a count of detection until the paper sheet X completely stops.

Note that since printing by the printing part 2 is not performed at this time, the hole detection sensor 4 do not detect the reference punched hole 41.

After the conveyance of the paper sheet X is stopped at the fourth conveying step S40, the second tension adjusting step ST2 is performed.

At the second tension adjusting step ST2, the press rollers 5*a* are once detached from the drive rollers 5*b* (refer to FIG. 1).

At the fourth conveying step S40 and the fifth conveying step S50, the directions in which the paper sheet X is conveyed are opposite, and therefore the tension provided to the paper sheet X is changed. However, by performing the second tension adjusting step ST2, the tension provided to the paper sheet X at the fourth conveying step S40 can be once eliminated.

Also, at the second tension adjusting step ST2, during acceleration of the paper sheet at the fifth conveying step S50, which will be described further below, the press rollers 5*a* are sequentially caused to abut on the drive rollers 5*b* from the upstream side with reference to the paper-sheet conveying direction.

With this, from the upstream side in the conveying direction, tension of the paper sheet X can be sequentially stabilized with a short span, and therefore the behavior of the paper sheet can be stabilized in a short time.

Next, at the fifth conveying step S50, by forwardly rotating the plurality of drive rollers 5*b* together, the paper sheet X is conveyed in the forward direction from the paper-feeding part 1 to the collecting part 7.

Note that at the fifth conveying step S50, the rotation speed of the drive roller 5*b* based on the above-described pulse signal from the control part is taken as a base and correction is respectively made so that the rotation speed of the drive roller 5*b* on the upstream side is slightly slower than the rotation speed of the drive roller 5*b* on the downstream side. With this, more appropriate tension is provided to the paper sheet X.

Incidentally, at the third conveying step S30, the drive roller 5*b* on the collecting part 7 side is rotated at a speed slower than that of the drive roller 5*b* on the paper-feeding part 1 side. However, at the fifth conveying step S50, since the conveying direction is opposite to that of the third conveying step S30, the drive roller 5*b* on the paper-feeding part 1 side is rotated at a speed slower than that of the drive roller 5*b* on the collecting part 7 side.

And, at the fifth conveying step S50, the recognizing step S51 is performed.

At the recognizing step S51, the mark detection sensor 3 detects the passing register mark G2, and a rear end PE of the rear-end unit image having a register mark G2' printed thereon when the count of detection matches a count number taken at the above-described count step S41 is recognized as a boundary between the print portion P1 and the non-print portion P0.

That is, at the recognizing step S51, it is recognized that from a state of (e) of FIG. 3, during conveyance of the paper sheet X in the forward direction, the state becomes a state depicted in (f) of FIG. 3.

Furthermore, at the fifth conveying step S50, the reprinting step S52 is performed. Note that the reprinting step S52 may be started in a state in which the conveyance of the paper sheet X is accelerated or may be started in a state of being at the predetermined speed.

At the reprinting step S52, based on the register mark G2' at the rear end detected by the mark detection sensor 3 at the recognizing step S51, the hole detection sensor 4 detects an initial reference punched hole 41' of a next non-print portion P0 and based on the detection, the printing part 2 reprints the unit image G on the non-print portion P0 of the paper sheet X.

Here, a distance from the register mark G2' at the rear end detected by the mark detection sensor 3 at the recognizing step S51 to the initial reference punched hole 41' of the next non-print portion P0 is set in advance.

That is, upon receiving a detection signal from the mark detection sensor 3, the control part sends out a pulse signal corresponding to the distance from the register mark G2' at the rear end to the initial reference punched hole 41' set in advance. Based on this, each motor rotates the drive roller 5*b*. After the paper sheet X is conveyed by the above-described distance, the hole detection sensor 4 detects the initial reference punched hole 41'.

And, with repetition of detection of the reference punched hole 41 and printing based thereon, the unit image G can be continuously printed from the next non-print portion P0 at the position where printing is once stopped (the boundary between the print portion P1 and the non-print portion P0).

In this manner, in the printing method according to the present embodiment, the method includes the first conveying step S10, the printing step S11, the second conveying step S20, the first tension adjusting step ST1, the third conveying step S30, the fourth conveying step S40, the count step S41, the second tension adjusting step ST2, the fifth conveying step S50, the recognizing step S51, and the reprinting step S52. Thus, a paper sheet can be inhibited from being damaged at the time of conveyance, and reprinting can be efficiently started after printing is once stopped.

In particular, printing and reprinting are performed with reference to not the register mark G2 included in the unit image G but the reference punched hole 41 formed in the paper sheet X itself. Therefore, printing with high positional accuracy can be made.

Also, in conveyance of the paper sheet X in the forward direction or the reverse direction, the paper sheet X is prevented by the meander preventing apparatuses 6 from being shifted in the width direction. Therefore, at the printing step S11, the count step S41, the recognizing step S51, and the reprinting step S52, an error based on a shift of the paper sheet X in the width direction can be prevented.

While the suitable embodiment of the present invention has been described above, the present invention is not restricted to the above-described embodiment.

In the printing apparatus A where the printing method according to the present embodiment is used, a drying machine, a perforation making machine, a folding machine, a cutting machine, and so forth may be further provided in the conveyance route of the paper sheet X.

In the printing apparatus A where the printing method according to the present embodiment is used, fanfold paper is cited as the paper sheet X, but this is not meant to be restrictive.

Also, the paper sheet X may be any as long as it is long and has a plurality of punched holes provided on both sides along the longitudinal direction, and perforations are not indispensable.

In the printing apparatus A where the printing method according to the present embodiment is used, the paper-feeding part 1 sequentially feeds the paper sheet X placed in a state of being alternately folded along the perforations, but this is not meant to be restrictive.

Also, the collecting part 7 collects the paper sheet X by alternately folding it along the perforations, but this is not meant to be restrictive.

FIG. 4 is a schematic side view schematically depicting another printing apparatus where the printing method according to the present embodiment is used.

As depicted in FIG. 4, a printing apparatus B has a paper-feeding part 1*a* which supplies a long paper sheet X with a plurality of punched holes provided on both sides along a longitudinal direction, a printing part 2 which repeatedly prints a unit image formed of an image and a register mark on the paper sheet X, a mark detection sensor 3 for detecting the register mark, a hole detection sensor 4 for detecting a reference punched hole set from among the plurality of punched holes, press rollers 5 *a* and drive rollers 5*b* for nipping the paper sheet X for conveyance, a collecting part 7*b* which collects the printed paper sheet X, and meander preventing apparatuses 6 for preventing a meander of the paper sheet X.

In the printing apparatus B, the apparatus is identical to the printing apparatus A, except the structures of the paper-feeding part 1*a* and the collecting part 7*b* are different.

In the printing apparatus B, the paper-feeding part 1*a* sequentially feeds the paper sheet X in a state of being wound around a roll.

Also, the collecting part 7*b* collects the paper sheet X by winding up the paper sheet to a roll.

In the printing apparatuses A and B where the printing method according to the present embodiment is used, the plurality of press rollers 5*a* and drive rollers 5*b* are provided. However, they may be provided at least on the upstream side and the downstream side of the printing part 2. Note that paper-sheet conveyance is stabilized as the press rollers 5*a* and driver rollers 5*b* are provided more.

In the printing apparatuses A and B where the printing method according to the present embodiment is used, the forward meander preventing apparatus 6 and the backward meander preventing apparatus 6 are provided. However, they are not necessarily indispensable, and only either one may be provided.

In the printing method according to the present embodiment, while the method includes the first conveying step S10, the printing step S11, the second conveying step S20, the first tension adjusting step ST1, the third conveying step S30, the fourth conveying step S40, the count step S41, the second tension adjusting step ST2, the fifth conveying step S50, the recognizing step S51, and the reprinting step S52, the first tension adjusting step ST1 and the second tension adjusting step ST2 are not necessarily indispensable.

In the printing method according to the present embodiment, the register mark has a rectangular shape. However, this is not meant to be restrictive.

INDUSTRIAL APPLICABILITY

The printing method according to the present invention is suitably used in a printing apparatus which prints on a paper sheet when printing is started again after printing is once stopped.

With the printing method according to the present invention, the paper sheet can be inhibited from being damaged at the time of conveyance, and reprinting can be efficiently started with high positional accuracy after printing is once stopped.

REFERENCE SIGNS LIST

1,1*a* . . . paper-feeding part
2 . . . printing part
3 . . . mark detection sensor
3*a*, 4*a* . . . guide roll
4 . . . hole detection sensor
41 . . . reference punched hole
41' . . . initial reference punched hole
5*a* . . . press roller
5*b* . . . drive roller
6 . . . meander preventing apparatus
6*a* . . . detecting part
6*b* . . . twist-purpose roller
7, 7*b* . . . collecting part
7*a* . . . pendulum part
A, B . . . printing apparatus
G . . . unit image
G1 . . . image
G2 . . . register mark
G2' . . . register mark at a rear end
P0 . . . non-print portion
P1 . . . print portion
S10 . . . first conveying step
S11 . . . printing step
S20 . . . second conveying step
S30 . . . third conveying step
S40 . . . fourth conveying step
S41 . . . count step
S50 . . . fifth conveying step
S51 . . . recognizing step
S52 . . . reprinting step
ST1 . . . first tension adjusting step
ST2 . . . second tension adjusting step
X . . . paper sheet

The invention claimed is:

1. A printing method using a printing apparatus having a paper-feeding part which supplies a long paper sheet with a plurality of punched holes provided on both sides along a longitudinal direction, a printing part which prints a unit image formed of an image and a register mark on the paper sheet, a mark detection sensor for detecting the register mark, a hole detection sensor for detecting a reference punched hole set from among the plurality of punched holes, a press roller and a drive roller for nipping the paper sheet for conveyance, and a collecting part which collects the printed paper sheet, the mark detection sensor and the hole detection sensor disposed between the paper-feeding part and the printing part in a conveyance route of the paper sheet, the method comprising:

a first conveying step of conveying the paper sheet in a forward direction from the paper-feeding part to the collecting part by forwardly rotating the drive roller;

a printing step of detecting, by the hole detection sensor, the reference punched hole during the first conveying step and, based on the detection, printing, by the printing part, the unit image to form a print portion;

a second conveying step of stopping the printing to form a non-print portion and simultaneously applying a brake to the drive roller to gradually decelerate and then stop the conveyance of the paper sheet in the forward direction;

a third conveying step of conveying the paper sheet in a reverse direction from the collecting part to the paper-feeding part by reversely rotating the drive roller;

a fourth conveying step of applying a brake to the drive roller to gradually decelerate and then stop the conveyance of the paper sheet in the reverse direction;

a count step of detecting, by the mark detection sensor, the passing register mark during the third conveying step and the fourth conveying step and taking a count of the detection;

a fifth conveying step of conveying the paper sheet in the forward direction from the paper-feeding part to the collecting part by forwardly rotating the drive roller;

a recognizing step of detecting, by the mark detection sensor, the passing register mark during the fifth conveying step and recognizing a rear end of the unit image having the register mark printed thereon when the count of the detection matches a count number taken at the count step as a boundary between the print portion and the non-print portion; and a reprinting step of detecting, by the hole detection sensor, the reference punched hole of the non-print portion during the fifth conveying step and, based on the detection, reprinting, by the printing part, the unit image on the paper sheet, wherein a pitch between the reference punched holes matches a length of the unit image in a paper-sheet conveying direction.

2. The printing method according to claim 1, wherein at a position opposing the hole detection sensor, a guide roll for guiding the paper sheet is disposed via the paper sheet, and a color of the guide roll is different from a color of a circumferential edge of the punched holes of the paper sheet.

3. The printing method according to claim 1, wherein at the fourth conveying step, based on detection of the register mark by the mark detection sensor, a brake is applied to the drive roller.

4. The printing method according to claim 1, wherein the press roller is attachable to and detachable from the drive roller, and the method further comprises a first tension adjusting step of once detaching the press roller from the drive roller before the third conveying step and then causing the press roller to abut on the drive roller during the third conveying step; and a second tension adjusting step of once detaching the press roller from the drive roller before the fifth conveying step and then causing the press roller to abut on the drive roller during the fifth conveying step.

5. The printing method according to claim 4, wherein a plurality of said press rollers and said drive rollers are provided, at the first tension adjusting step, the press rollers are sequentially caused to abut on the drive rollers from an upstream side with respect to a conveying direction of the paper sheet at the third conveying step, and at the second tension adjusting step, the press rollers are sequentially caused to abut on the drive rollers from an upstream side with respect to a conveying direction of the paper sheet at the fifth conveying step.

6. The printing method according to claim 1, wherein a meander preventing apparatus is provided on a paper-feeding part side rather than the printing part, the mark detection sensor, and the hole detection sensor in the conveyance route of the paper sheet.

7. The printing method according to claim 1, wherein the plurality of punched holes provided on both sides of the paper sheet along the longitudinal direction are marginal punched holes, and a space between the unit images is sectioned by perforations.

* * * * *